US009044114B1

(12) United States Patent
Hudson

(10) Patent No.: US 9,044,114 B1
(45) Date of Patent: Jun. 2, 2015

(54) SNAP-IN REPLACEMENT CURTAIN HANGER AND METHOD

(71) Applicant: Ronald L. Hudson, Saucier, MS (US)

(72) Inventor: Ronald L. Hudson, Saucier, MS (US)

( * ) Notice: Subject to any disclaimer, the term of this patent is extended or adjusted under 35 U.S.C. 154(b) by 0 days.

(21) Appl. No.: 14/305,250

(22) Filed: Jun. 16, 2014

(51) Int. Cl.
*A47H 13/00* (2006.01)
*A47H 1/00* (2006.01)
*A47H 1/18* (2006.01)

(52) U.S. Cl.
CPC .. *A47H 1/00* (2013.01); *A47H 1/18* (2013.01); *A47H 2201/00* (2013.01)

(58) Field of Classification Search
CPC ..... A47H 13/00; A47H 13/04; A47H 15/04
USPC ..... 16/87.4 R, 93 R, 93 D, 94 D, 95 R, 95 D, 16/96 D
See application file for complete search history.

(56) References Cited

U.S. PATENT DOCUMENTS 1,691,339 A 11/1928 Deming
D167,831 S * 9/1952 Graber et al. ..... D8/367
2,654,114 A * 10/1953 Graber et al. ..... 16/93 D
2,683,890 A * 7/1954 Rosenbaum ..... 16/87.4 R
2,848,735 A 8/1958 Ault et al.
3,262,148 A * 7/1966 Saltz ..... 16/87.4 R
3,314,100 A * 4/1967 Znamirowski ..... 16/87.4 R
3,324,501 A * 6/1967 Lydard ..... 16/87.4 R
3,359,592 A * 12/1967 Saltz ..... 16/93 D
3,378,879 A * 4/1968 Stall ..... 16/87.4 R
3,543,328 A * 12/1970 Liborio et al. ..... 16/87.4 R
3,616,486 A 11/1971 Bell et al
3,703,740 A 11/1972 Mankofsky et al.
3,982,581 A 9/1976 Madsen
4,227,282 A 10/1980 Ford
4,584,737 A 4/1986 Ohman
D308,467 S * 6/1990 Fenton ..... D8/373
5,111,868 A 5/1992 Sawaya
5,609,197 A * 3/1997 Liao ..... 160/330
5,769,144 A 6/1998 Carter
5,903,957 A 5/1999 Le Manchec

* cited by examiner

*Primary Examiner* — Roberta Delisle
(74) *Attorney, Agent, or Firm* — Paul R. Martin

(57) ABSTRACT

A product that can be used to repair curtain hangers and/or extend them and includes a bipedal attachment that affixes to a standard curtain hanger. In order to repair a broken or damaged hanger, simply slide the hanger parallel to the curtain slide and snap into position. Afterwards rotate the handle ninety degrees and the task is finished. The invention further contemplates a method for removing and replacing curtain hangers in an expeditious and safe manner.

4 Claims, 2 Drawing Sheets

SNAP-IN REPLACEMENT CURTAIN HANGER AND METHOD

TECHNICAL FIELD OF THE INVENTION

The present invention relates to the general art of curtain hangers, and to the particular field of replacement curtain hangers.

BACKGROUND OF THE INVENTION

When mounting draperies it is common practice to employ elongated, horizontally disposed traverse rods to support the draperies. Traverse rods generally comprise roll-formed sheet metal members, C-shaped in cross-section to define a longitudinally extending slot with a pair of straight, parallel, and laterally spaced rails or guide edges on each side of the slot. The rods are normally mounted at each end longitudinally above and across a vertical planar area in which it is desired to suspend the draperies. The individual drapery carriers are slidable with respect to the traverse rod and have openings therein which receive drapery or pleater hooks for supporting the drapery material.

Drapery glides or carriers previously adapted for use with conventional traverse rods generally comprises a body member having a retainer or head portion and a neck portion, with the retainer portion adapted to be inserted into the elongated slot of the traverse rod either through the ends of the rod or directly through the slot while the neck portion is adapted to ride on and extend through and between the rails or guide edges. In these glides or carriers used heretofore, a hook member is loosely suspended on the pendant portion of the body member which extends downwardly from the neck portion outside the slot of the traverse rod. The hook members engage the hem of the draperies and the draperies hang vertically from the hood members.

In providing means for mounting drapery panels onto the sliders of a traverse rod, there has long been recognized the problem of enabling said panels to be quickly applied to said traverse rod and equally quickly removable therefrom. This is desirable for washing or otherwise cleaning the drapery material and/or for applying, removing or changing the drapery material according to the season. Thus, for example, in a given southerly or southwesterly facing room with a large picture window, it may be desirable to have a sun-shading type of drapery, such as a drapery comprising vertically arranged wooden slats during the winter when the sun is low and would otherwise shine into the room but equally desirable to provide a wholly different type of drapery, as one made of a lighter cloth-like material, during the summer when the sun is higher. Alternatively, in other circumstances, it may be desirable to have the sun-shading type of drapery during the summer to provide shade against a late afternoon sun when the heat therefrom is undesirable but to provide a relatively light drapery for use in winter when the entry of the sun's rays is desired.

While this subject has been addressed in the past, and a number of designs have been suggested for this purpose, none of them provide fully the ease of operation desired particularly in connection with relatively stiff draperies such as those comprising vertically arranged slats, such as wooden slats, and with minimal spacing between the upper end of the drapery and the traverse rod means.

The drapery carriers commonly consist of members having enlarged heads which are adapted to engage opposite edges of a slot in the track and which must be inserted from the ends of the track prior to the suspension of the track from the structure on which it is to be supported. During prolonged usage of the carriers, they tend to wear out or be jammed in the track and the necessity for their removal in order to insert a properly operating carrier arises.

In conventional constructions this entails the removal of all of the carriers from the end of the track to permit the removal of the offending carrier which is both a time consuming and tedious job when it is considered that the track is frequently suspended in a relatively inaccessible position on the interior of a valance board or other structure.

Therefore, there is a need for a drapery carrier which can be readily inserted at any point along the length of the track which thus obviates the necessity for the insertion of the carrier from the end thereof and a method of effecting this operation. Thus, if a carrier should fail or if it be desired to insert a larger number of carriers to support a drapery, or to remove a surplusage of carriers after the track has been installed, the carriers can be inserted or removed at the desired points along the length of the track without the removal of the previously installed carriers. This should be as expeditious as possible and should not expose the carriers to undue risk of damage during the removal or insertion process.

There is a further need for a drapery carrier which includes a body formed in a manner which facilitates efficient and reliable placement of the carrier on a traverse rod as well as efficient and reliable removal of the carrier from the traverse rod as well as a method of utilizing the carrier in the most efficient and safe manner.

SUMMARY OF THE INVENTION

The above-discussed disadvantages of the prior art are overcome by a product that can be used to repair curtain hangers and/or extend them and includes a bipedal attachment that affixes to a standard curtain hanger. In order to repair a broken or damaged hanger, simply slide the hanger parallel to the curtain slide and snap into position. Afterwards rotate the handle ninety degrees and the task is finished. The invention further contemplates a method for removing and replacing curtain hangers in an expeditious and safe manner.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 1:
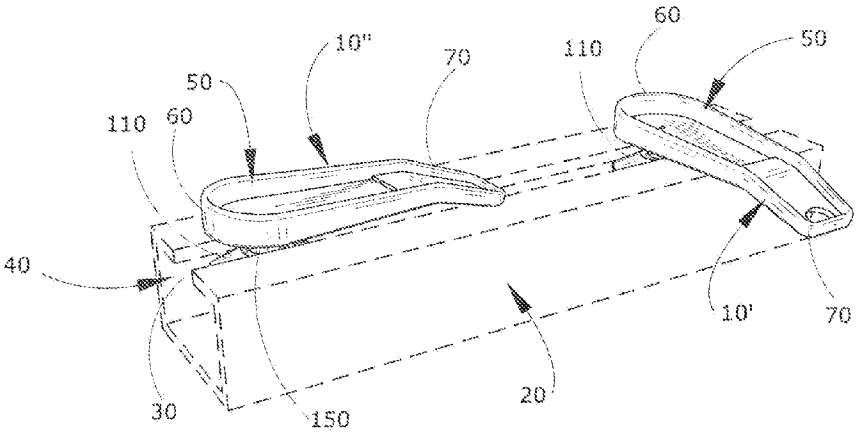
FIG. 1 is a perspective view of a traverse rod in combination with curtain hangers which are included in the present invention.
Figure 2:
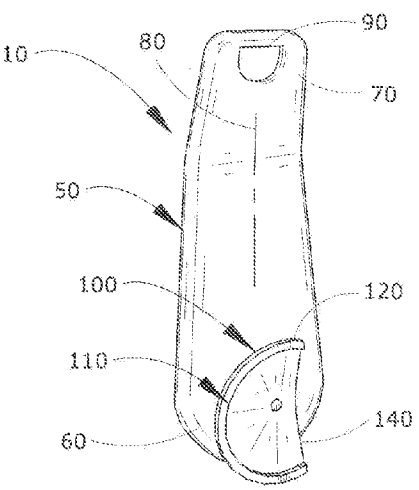
FIG. 2 is a side perspective view of a curtain hanger which is included in the present invention.
Figure 3:
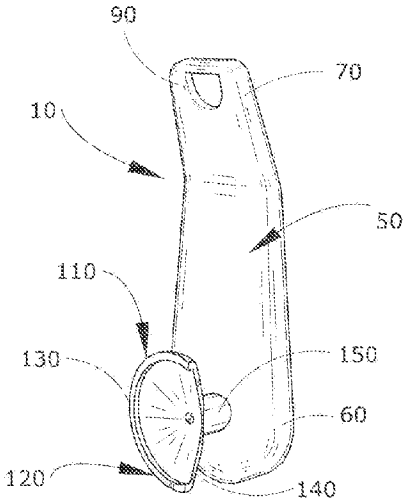
FIG. 3 is a side perspective view of a curtain hanger which is included in the present invention as seen from the side opposite to the side shown in FIG. 2

Referring to the figures, it can be understood that the present invention is embodied in a replacement curtain hanger 10 for use with a hollow C-shaped traverse rod 20 which accommodates curtain hangers and which has a slot 30 defined therein for accommodating support portions of the curtain hangers. The slot extends longitudinally of the traverse rod and provides an entrance into the interior 40 of that rod.

The replacement curtain hanger 10 comprises a one-piece hanger body 50 which preferably is formed of plastics material. The one-piece hanger body has a first end 60 which is located adjacent to slot 30 defined in the traverse rod when the replacement curtain hanger is in use, with replacement curtain hanger 10' being shown in the use orientation. Body 50 has a second end 70 which is spaced apart from the slot defined in the traverse rod when the replacement curtain hanger is in use, and a longitudinal axis 80 which extends between the first end 60 and the second end 70 of the one-piece hanger. A hook-accommodating hole 90 is defined through the one-piece body adjacent to second end 70 of the hanger body.

A traverse rod engaging element 100 is one-piece with the one-piece hanger body and is located adjacent to first end 60 of the hanger body. Traverse rod engaging element 100 includes a concave body 110 having a semi-circular periphery 120 with one portion 130 of the periphery being arcuate in shape and a second portion 140 of the periphery being linear. The arcuate portion of the semi-circular periphery extends for more than 180° and thus extends for more than one half of the total periphery of the concave body, and the linear portion extends parallel to the longitudinal axis 80. A connecting rod 150 extends between the concave body of the traverse rod engaging element and the hanger body.

Figure 4:
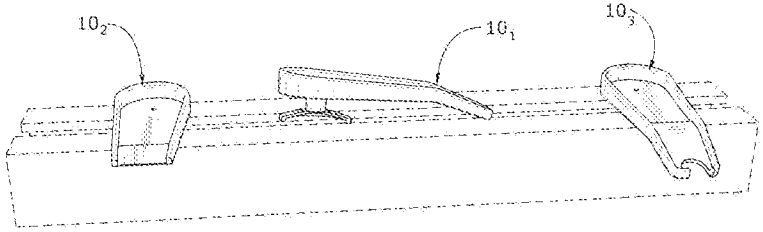
FIG. 4 shows one step in the process included in the present invention.
Figure 5:
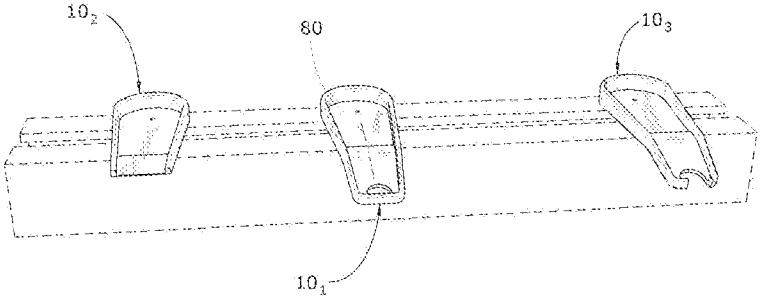
FIG. 5 shows another step in the process included in the present invention.

The invention also contemplates a method of replacing curtain hangers with the replacement curtain hanger described above. Referring to FIGS. 1, 4 and 5, the method includes steps of providing the replacement hanger described above; orienting the hanger body so the longitudinal axis thereof is oriented parallel to the slot defined in the traverse rod and the linear portion of the periphery of the concave body is located adjacent to one portion of the slot as can be understood from the orientation of hanger 10" in FIGS. 1 and $\mathbf{10}_1$ in FIG. 4; tilting the hanger body so the arcuate portion of the periphery of the concave body can pass through the slot; forcing the arcuate portion of the periphery of the concave body through the slot of the traverse rod. The method continues by forcing the linear portion of periphery of the concave body through the slot whereby the entire concave body is located on one side of the traverse rod and the hanger body is located on another side of the traverse rod with the connecting rod extending through the slot defined in the traverse rod, the linear portion and its size relative to the remainder of the overall periphery facilitates the step of forcing the hanger body through the slot and the relative size of the arcuate portion with respect to the linear portion facilitates maintaining the hanger in the slot while allowing it to be forced through the slot in an expeditious manner. The relative size of the arcuate portion of the element 100 to the remainder of the element 100 allows the element to be inserted through the slot and securely hold its position while the remainder of the element is forced through the slot, and the linear portion of the element 100 being linear allows that portion to clear the linear edge of the slot without deforming the element. The relative size of the linear portion allows this clearing to occur without deforming the element 100 because the majority of the element is already inside the traverse rod when the linear portion is forced past the edge of the slot. The one-piece nature of the hanger allows the plastic body to flex in a manner which facilitates insertion and removal of the hanger with respect to the traverse rod by moving the concave body through the slot in an expeditious manner which does not damage the concave body. The method further includes the step of orienting the hanger body so the longitudinal axis thereof is at a right angle to the slot defined in the traverse rod and the hook-accommodating hole is spaced apart from the slot of the traverse rod as can be seen from the orientation of curtain hanger 10' in FIGS. 1 and $\mathbf{10}_1$ in FIG. 4. The parallel relative orientation between linear portion 140 and longitudinal axis 80 facilitates expeditious placement and removal of curtain hanger 10 on and from traverse rod 20 respectively.

The method also includes removing a curtain hanger from the traverse rod. The removal step includes orienting the hanger body from the orientation shown for curtain hanger 10' to the orientation shown for curtain hanger 10" with respect to slot 30 of traverse rod 20 so the longitudinal axis thereof is oriented parallel to the slot defined in the traverse rod and the linear portion of the periphery of the concave body is located adjacent to one portion of the slot; tilting the hanger body so the arcuate portion of the periphery of the concave body can pass through the slot; pulling the arcuate portion of the periphery of the concave body through the slot of the traverse rod; and pulling the linear portion of periphery of the concave body through the slot whereby the entire concave body is located on one side of the traverse rod outside the slot. the linear portion and its size relative to the remainder of the overall periphery facilitates the step of pulling the hanger body through the slot.

Removing a damaged hanger, such as damaged hangers $\mathbf{10}_2$ and $\mathbf{10}_3$ shown in FIGS. 4 and 5, involves reversing the just-described method steps with regard to the damaged hangers. That is, the damaged hanger is removed from the traverse rod by a method which includes the following steps: orienting the hanger body so the longitudinal axis thereof is oriented parallel to the slot defined in the traverse rod and the linear portion of the periphery of the concave body is located adjacent to one portion of the slot; tilting the hanger body so the arcuate portion of the periphery of the concave body can pass through the slot; pulling the arcuate portion of the periphery of the concave body through the slot of the traverse rod; and pulling the linear portion of periphery of the concave body through the slot whereby the entire concave body is located on one side of the traverse rod outside the slot.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A replacement curtain hanger for use with a traverse rod which accommodates curtain hangers and which has a slot defined therein for accommodating support portions of the curtain hangers, the replacement curtain hanger comprising:

a one-piece hanger body having a first end which is located adjacent to the slot defined in the traverse rod when the replacement curtain hanger is in use, a second end which is spaced apart from the slot defined in the traverse rod when the replacement curtain hanger is in use, a longitudinal axis which extends between the first end and the second end of the one-piece hanger, a hook-accommodating hole defined through the one-piece body adjacent to the second end of the hanger body, and a traverse rod engaging element which is one-piece with the one-piece hanger body and which is located adjacent to the first end of the hanger body, the traverse rod engaging element including a concave body having a semi-circular periphery with one portion of the periphery being arcuate in shape and a second portion of the periphery being linear, the arcuate portion of the semi-circular periphery extending more than one half of the total periphery of the concave body, the linear portion of the periphery extending parallel to the longitudinal axis, and a connecting rod extending between the concave body of the traverse rod engaging element and the hanger body.

2. The replacement curtain hanger defined in claim 1 wherein the one-piece hanger body is plastics material.

3. A method of replacing a curtain hanger which is associated with a traverse rod having a slot defined therein for accommodating portions of curtain hangers, the method comprising steps of:

providing a one-piece hanger body having a first end which is located adjacent to the slot defined in the traverse rod when the replacement curtain hanger is in use, a second end which is spaced apart from the slot defined in the traverse rod when the replacement curtain hanger is in use, a longitudinal axis which extends between the first end and the second end of the one-piece hanger, a hook-accommodating hole defined through the one-piece body adjacent to the second end of the hanger body, and a traverse rod engaging element which is one-piece with the one-piece hanger body and which is located adjacent to the first end of the hanger body, the traverse rod engaging element including a concave body having a semi-circular periphery with one portion of the periphery being arcuate in shape and a second portion of the periphery being linear, the arcuate portion of the semi-circular periphery extending more than one half of the total periphery of the concave body, and a connecting rod extending between the concave body of the traverse rod engaging element and the hanger body; and orienting the hanger body so the longitudinal axis thereof is oriented parallel to the slot defined in the traverse rod and the linear portion of the periphery of the concave body is located adjacent to one portion of the slot;

tilting the hanger body so the arcuate portion of the periphery of the concave body can pass through the slot;

forcing the arcuate portion of the periphery of the concave body through the slot of the traverse rod;

forcing the linear portion of periphery of the concave body through the slot whereby the entire concave body is located on one side of the traverse rod and the hanger body is located on another side of the traverse rod with the connecting rod extending through the slot defined in the traverse rod; and orienting the hanger body so the longitudinal axis thereof is at a right angle to the slot defined in the traverse rod and the hook-accommodating hole is spaced apart from the slot of the traverse rod.

4. The method defined in claim 3 further including a step of removing a curtain hanger from the traverse rod which removal step includes orienting the hanger body so the longitudinal axis thereof is oriented parallel to the slot defined in the traverse rod and the linear portion of the periphery of the concave body is located adjacent to one portion of the slot;

tilting the hanger body so the arcuate portion of the periphery of the concave body can pass through the slot;

pulling the arcuate portion of the periphery of the concave body through the slot of the traverse rod; and pulling the linear portion of periphery of the concave body through the slot whereby the entire concave body is located on one side of the traverse rod outside the slot.

* * * * *